US009833071B2

(12) United States Patent
Heyring et al.

(10) Patent No.: US 9,833,071 B2
(45) Date of Patent: Dec. 5, 2017

(54) STABILISATION ARRANGEMENTS

(71) Applicant: NO ROCK CAFE TABLES PTY LTD, Eagle Bay (AU)

(72) Inventors: Brian Christopher Heyring, Eagle Bay (AU); Toby William Heyring, Eagle Bay (AU); John Gerard Catoni, Dunsborough (AU); Richard Monk, Yalyalup (AU)

(73) Assignee: No Rock Cafe Tables Pty Ltd., Eagle Bay (AU)

( * ) Notice: Subject to any disclaimer, the term of this patent is extended or adjusted under 35 U.S.C. 154(b) by 0 days.

(21) Appl. No.: 14/436,082

(22) PCT Filed: Oct. 18, 2013

(86) PCT No.: PCT/AU2013/001205

§ 371 (c)(1),
(2) Date: Apr. 16, 2015

(87) PCT Pub. No.: WO2014/059481

PCT Pub. Date: Apr. 24, 2014

(65) Prior Publication Data

US 2015/0313358 A1 Nov. 5, 2015

(30) Foreign Application Priority Data

Oct. 18, 2012 (AU) ..... 2012904554

(51) Int. Cl.

| | |
|---|---|
| ***F16M 11/24*** | (2006.01) |
| ***A47B 91/16*** | (2006.01) |
| ***A47B 13/02*** | (2006.01) |

(52) U.S. Cl.

CPC ..... *A47B 91/16* (2013.01); *A47B 13/021* (2013.01); *A47B 13/023* (2013.01); *A47B 2013/025* (2013.01)

(58) Field of Classification Search

CPC ..... A47B 13/021; A47B 13/023; A47B 2013/025; A47B 91/16; A47B 13/02

(Continued)

(56) References Cited

U.S. PATENT DOCUMENTS 801,966 A * 10/1905 Breiding ..... A47C 9/105 108/128
2,245,713 A * 6/1941 Redmond ..... A47C 1/024 248/188.3

(Continued)

FOREIGN PATENT DOCUMENTS

| | | | |
|---|---|---|---|
| FR | 2607878 | A1 | 6/1988 |
| WO | 2011075793 | A1 | 6/2011 |
| WO | 2011107677 | A1 | 9/2011 |

*Primary Examiner* — Kimberly Wood
(74) *Attorney, Agent, or Firm* — Charles H Jew

(57) ABSTRACT

A stabilizing arrangement (1) to support an object above four ground engaging means (2*c*,3*c*,4*c*,5*c*) has first 2, second 3, third 4 and fourth 5 levers each having a beam portion (2*a*,3*a*,4*a*,5*a*), an actuating portion (2*b*,3*b*,4*b*,5*b*) and a ground engaging means (2*c*,3*c*,4*c*,5*c*). Each lever is connected to a common interconnection means (6) by a respective pivot with a pivot axis. The levers engage consecutively first to second, second to third, third to fourth and fourth to first, via respective projections (2*d*,3*d*,4*d*,5*d*) permitting ground engaging means warp displacement and thereby the arrangement provides support of the object on uneven ground. For each lever part, the distance a between the respective ground engaging means and the respective pivot axis is a primary lever-rotating moment arm, and the distance b between the respective ground engaging means and the centre of the pivot is a friction loading distance. The friction loading distance b can be greater than or equal to the primary lever-rotating moment arm a.

17 Claims, 6 Drawing Sheets

(58) Field of Classification Search
USPC .... 248/150, 151, 163.1, 165, 166, 170, 171, 248/188.3, 188.2, 188.9, 188.8; 108/150, 108/153.1, 154, 155, 157.1, 158.11
See application file for complete search history.

(56) References Cited

U.S. PATENT DOCUMENTS 2,787,087 A * 4/1957 Whitman ..... A47B 91/16 108/150
2,836,007 A * 5/1958 Dodds ..... A47B 13/023 248/188.3
3,117,392 A * 1/1964 Junkunc ..... A47B 91/16 108/147.19
3,185,423 A * 5/1965 Jones, III ..... A47B 91/16 108/150
3,278,147 A * 10/1966 Olander ..... D06F 81/00 248/188.3
3,814,362 A * 6/1974 Ritchie ..... A47B 91/16 248/188.3
4,053,129 A * 10/1977 Graff ..... A47C 7/004 16/42 R
4,257,618 A * 3/1981 Tax ..... F16M 11/20 180/41
4,406,437 A * 9/1983 Wright ..... F16M 11/00 248/188.7
4,712,758 A * 12/1987 Cuschera ..... A47B 13/023 248/188.7
4,789,122 A * 12/1988 Gutgsell ..... A47B 13/023 108/150
5,365,862 A * 11/1994 Peterson ..... A47B 9/00 108/147
5,402,973 A * 4/1995 Haines ..... A47C 7/004 248/188.7
5,690,303 A * 11/1997 Winters ..... A47B 91/00 248/188.3
5,913,498 A * 6/1999 Brown ..... A47B 91/024 248/188.2
7,930,980 B2 * 4/2011 Brooke ..... A47B 13/023 108/153.1
8,607,715 B2 * 12/2013 Catoni ..... A47B 91/16 108/150
8,870,134 B2 * 10/2014 Catoni ..... A47B 91/16 108/155
8,997,662 B2 * 4/2015 Heyring ..... A47B 13/02 108/115
2003/0230681 A1 * 12/2003 Gwynneth ..... A47B 91/16 248/188.3
2007/0252053 A1 * 11/2007 Brooke ..... A47B 13/023 248/188.3

* cited by examiner

STABILISATION ARRANGEMENTS

FIELD OF THE INVENTION

The present invention relates to improvements in stabilisation arrangements for objects such as furniture and appliances and is specifically related to the friction and/or damping of said mechanisms.

BACKGROUND TO THE INVENTION

A stabilizing arrangement to support an object is disclosed in the applicant's earlier International Patent Application No. PCT/AU2010/001745, which is published as WO 2011/075793 A1 and which is incorporated herein by reference. The stabilizing arrangement includes at least four ground engaging means, each being pivoted to an interconnection means (or hub) and including first and second engaging regions. The first engaging region of each ground engaging means is engaged with the second engaging region of an adjacent ground engaging means such that said at least four ground engaging means can conform to an uneven surface (i.e. operate in a warp-like mode) while providing support for the object which may be a table top attached to the hub via a stem.

To provide damping of the mechanism, a bolt providing the pivot between a ground engaging means and an interconnection means can be used to pull the ground engaging means and the interconnection means together loading the sliding surfaces therebetween. The torque of the bolt and the materials and surface finishes of the sliding surfaces can be adjusted or selected to provide the required level of damping in the mechanism. However in some cases, when the damping provided is at a level to restrict the unnecessary operation of the mechanism when an eccentric or angled force is applied to the mechanism or to the object being supported, that level of damping can be too high to allow the mechanism to conform to an uneven surface under its own weight or as it is being repositioned.

It would therefore be desirable to provide an improved stabilizing arrangement in which the force at the sliding surfaces is more sensitive to the vertical support force on the feet of the ground engaging means.

SUMMARY OF THE INVENTION

With this in mind, one or more forms of the present invention may provide a stabilizing arrangement to support an object above four ground engaging means, the arrangement including: an interconnection means interconnecting four lever parts including a first lever part, a second lever part, a third lever part and a fourth lever part, each connected to the interconnection means by a respective pivot having a respective pivot axis; each respective lever part including a first and a second engaging region, the first engaging region of each respective lever part being located on an opposite side of the respective pivot axis to the second engaging region of the respective lever part in plan view; each respective ground engaging means being attached to or integral with a respective lever part, the respective ground engaging means of each lever part being located on an opposite side of the respective pivot axis to the respective first engaging region; the first engaging region of the first lever part, in use engaged with the second engaging region of the second lever part, the first engaging region of the second lever part, in use engaged with the second engaging region of the third lever part, the first engaging region of the third lever part, in use engaged with the second engaging region of the fourth lever part, the first engaging region of the fourth lever part, in use, engaged with the second engaging region of the first lever part such that rotation of the first lever part drives a rotation of the second lever part which drives rotation of the third lever part in a substantially opposite direction to the first lever part and the rotation of the third lever part driving a rotation of the fourth lever part in a substantially opposite direction to the second lever part to permit a warp displacement of the four ground engaging means, the stabilizing arrangement thereby providing support of the object on uneven ground.

For each respective lever part, the distance between the respective ground engaging means and the respective pivot axis may be or define a primary lever-rotating moment arm. The distance between the respective ground engaging means and the centre of the pivot or a portion of the pivot may be or define a friction loading distance. The friction loading distance may be greater than (or equal to) the primary lever-rotating moment arm. This can alternatively be defined as a ratio of lever-rotating moment arm length to friction loading distance that is less than 1:1.

It will be appreciated that the respective lever parts may preferably rotate about a horizontal axis perpendicular to the pivot axis when load is applied. The bearing material may compress or more likely the clearance between the leg and the hub changes e.g. at the friction contact point between the lever part and the interconnection means. The portion of the pivot may be within the lever part e.g. a portion of a pin or bolt acting as a pivot which extends into the respective lever part. Alternatively, the pivot may be integral with the lever part (e.g. moulded or cast) and the pivot rotates within a hole in the interconnection means or hub.

The length of the lever-rotating moment arm and the friction loading distance are preferably both measured in a substantially horizontal plane that is parallel to the average ground plane or parallel to a plane through the interconnecting means that is horizontal when the four ground engaging means are in contact with a (flat) plane that is horizontal.

The distance of the first or second engaging region of a said lever part from the pivot axis of said lever part may be a beam loading distance. Preferably the ratio between the lever-rotating moment arm and the beam loading distance is between 1.5:1 and 4:1.

Additionally or alternatively an angular separation (projected in plan view) of the ground engaging means of each of the lever parts relative to the respective pivot axis for the respective lever part is less than 45 degrees and greater than 0 degrees. This angular separation may preferably be between 35 and 10 degrees, or between 30 and 15 degrees, or between 25 and 20 degrees and may preferably be approximately 22.5 degrees.

Additionally or alternatively the stabilizing arrangement may include a respective sliding interface between each respective lever part and a respective side of the interconnection means. The respective pivot may be below a centre of the respective sliding interface. At least one of said respective sliding interfaces may include a bearing integrated into (such as bonded to or inserted into a recess in) the respective lever part or the respective side of the interconnection means.

Additionally or alternatively the first engaging region of each lever part may be a protrusion and the second engaging region of each lever part may be a receiving hole. The protrusion of each lever part may be a cylindrical pin having a distal end that is at least partially rounded and the receiving hole of each lever part may be an elongate opening having rounded or curved ends. The protrusion of each lever part may, in use, contact the receiving hole of an adjacent lever part at an instantaneous engaging zone. The protrusions and receiving holes may be positioned such that when all the ground engaging means lie on a common (flat) ground plane, the instantaneous engaging zones and preferably the pivot axes substantially lie on a plane parallel to the common ground plane.

It will be convenient to further describe the invention by reference to the accompanying drawings which illustrate preferred aspects of the invention. Other embodiments of the invention are possible and consequently particularity of the accompanying drawings is not to be understood as superceding the generality of the preceding description of the invention.

DESCRIPTION OF PREFERRED EMBODIMENT

Figure 1:
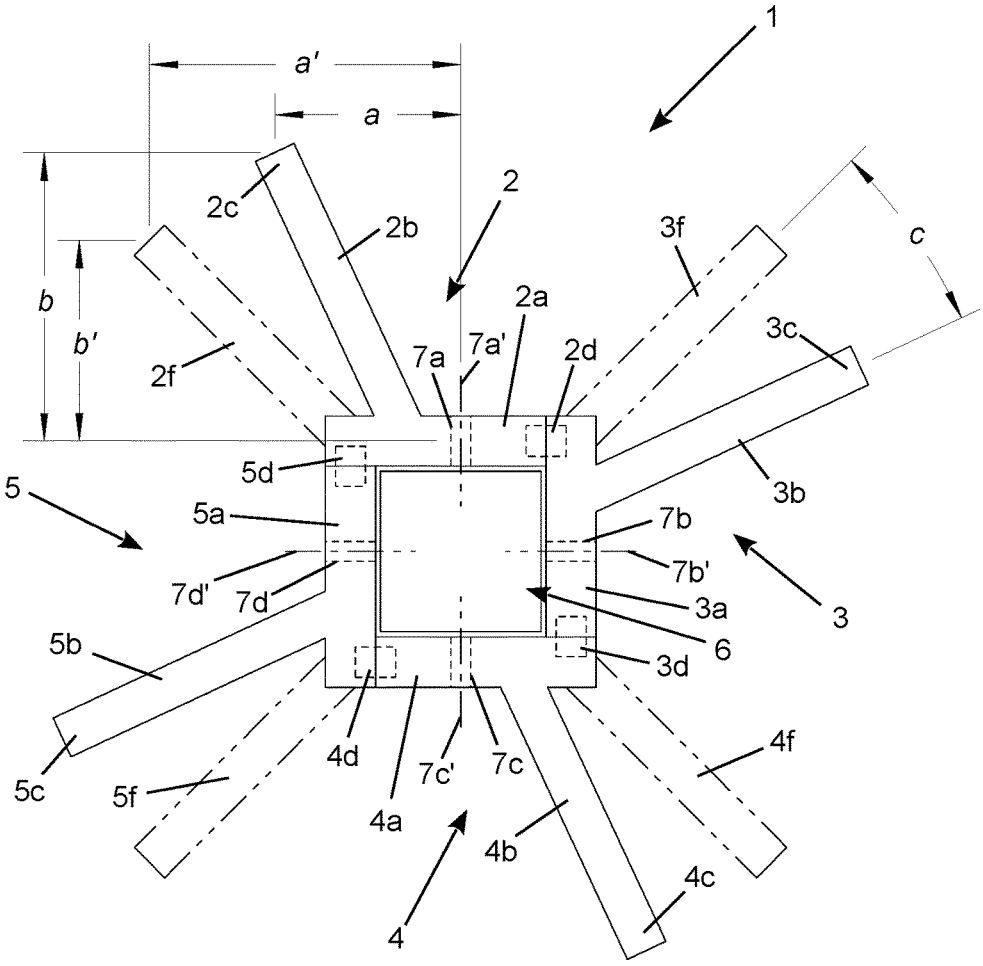
FIG. 1 is a schematic plan view of a first possible embodiment of a stabilizing arrangement of the present invention.

Referring initially to FIG. 1 there is shown a schematic plan view of the stabilizing arrangement 1 in which the geometry of the applicant's prior International Patent Application Number PCT (details of which are incorporated herein by reference) is also shown in phantom lines. Four lever parts or legs 2, 3, 4 and 5 are connected to a hub or base portion 6 (which may be generically referred to as an interconnection means). Each leg includes a beam portion 2*a*, 3*a*, 4*a* or 5*a*, these beam portions being arranged in a square layout around the base portion 6. An actuating portion (2*b*, 3*b*, 4*b* or 5*b* respectively) extends from the beam portion of each leg towards a point or region 2*c*, 3*c*, 4*c* or 5*c* where the leg contacts the ground or other surface.

Each beam portion (2*a*, 3*a*, 4*a* or 5*a*) is pivotally connected to the base portion 6 by a bolt or similar pivot 7*a*, 7*b*, 7*c*, 7*d* (or fixing such as a rivet or a shaft with a retaining circlip for example) such that each leg is able to rotate about its own pivot axis 7*a*', 7*b*', 7*c*', 7*d*'. A protrusion 2*d*, 3*d*, 4*d*, or 5*d* extends from the beam portion of each leg to engage the beam portion of the adjacent leg to transfer force and position therebetween. As shown in FIG. 1 the protrusion extends from the end of each leg into the side of the adjacent leg or to bear downwards on an engaging region of the adjacent arm in use (assuming that the protrusion is on the opposite side of the pivot axis to the ground engaging region of the respective leg as shown). Alternatively it is possible for the protrusion to extend from the side of each leg into the end of the adjacent leg or to bear upwards on an engaging region of the adjacent arm in use (assuming that the protrusion is on the opposite side of the pivot axis to the ground engaging region of the respective leg as shown). The pivots (i.e. bolts 7) together with the (inter)connections provided by the protrusions and engaging regions of the legs provide a mechanism in which the ground engaging regions of adjacent legs move in opposite vertical directions and the ground engaging regions of opposite legs move a in common vertical direction. The base portion 6 lies parallel to the average ground plane which is a linear plane through the average of the four ground engaging regions (contact points with the ground surface). Through this mechanism, the stabilizing arrangement can maintain the ground engaging regions of all legs in contact with the ground, even when the ground is an uneven surface and the ground engaging regions do not therefore lie in a common linear plane (i.e. the ground plane is warped). When on an uneven surface, all ground engaging regions are load bearing and carry substantially the same load as if they were sitting on the linear plane which is the average ground plane.

The position of the ground engaging end of each leg from the respective pivot axis not only influences the direction of the couple at the protrusion and the engaging region of the respective leg, but also the magnitude of that couple.

The damping of the stabilizing arrangement is influenced by the friction of the rotation of the beam portion of one or more of the respective legs. That can be done by adjusting the preload of the respective beam portion against the base portion 6, for example by setting the tightening torque for the respective bolt 7. The use of a spring washer or other resilient means can be used to minimise the change in preload due to wear over time with heavy usage, or for example in corrosive or particularly abrasive environments. The friction can also be affected by the materials of and surface finish between the two sliding surfaces (one on the beam portion and one on the base portion).

Reducing the distance (a) of the ground engaging end (ie 2*c*) of a leg from the pivot axis of the leg reduces the input moment induced on the leg about the pivot axis by the reaction force with the ground. The legs of the prior art had ground engaging means on actuating portions that were either in line with the beam portions or extending at forty-five degrees from the ends of the beam portions (as shown in phantom lines at 2*f*, 3*f*, 4*f*, or 5*f* in FIG. 1). In the present invention, to reduce the distance a while maintaining the same footprint, the angle of the actuating portion of each leg is rotated through an angle c (which in the example in FIG. 1 is twenty degrees) further past the forty-five degrees of some of the prior art embodiments. This reduces the distance a which reduces the input moment on the leg which also effectively increases the damping of the stabilizing arrangement by reducing the input moment while maintaining the same frictional characteristic between the two sliding surfaces. The distance a may be referred to as the primary lever-rotating moment arm and is preferably measured in a plane parallel to the average ground plane and in a direction perpendicular to the respective pivot axis.

The distance (b) between the centre of the hole in the beam portion (2*a*) of a respective leg around a bolt 7 (or any suitable point about which the support for through the foot of the leg levers the sliding surface of the leg on to the sliding surface of the base) and the foot or ground engaging region 2*c* may be referred to as the friction loading distance. This friction loading distance b is preferably measured in a direction parallel with the respective pivot axis. The point defining the hub or base end of the distance b can for example be a portion of the pivot which may be within the lever part e.g. a portion of a pin or bolt acting as a pivot which extends into the respective lever part. Alternatively, the pivot may be integral with the lever part (e.g. moulded or cast) and the pivot rotates within a hole in the interconnection means or hub. In the prior art where the actuating arm is either in line with the beam portion of the respective leg or attached to the end of the beam portion at an angle of forty five degrees, the primary lever-rotating moment arm a' is always greater (ie longer than) the friction loading distance b'. However, according to the present invention, the friction loading distance b is preferably greater than (or equal to) the primary lever-rotating moment arm a. This can alternatively be defined as a ratio of lever-rotating moment arm length to friction loading distance that is less than 1:1. This characteristic provides increased friction and therefore damping in the stabilizing arrangement for a given coefficient of friction (ie using common materials and tightening torque).

Figure 2:
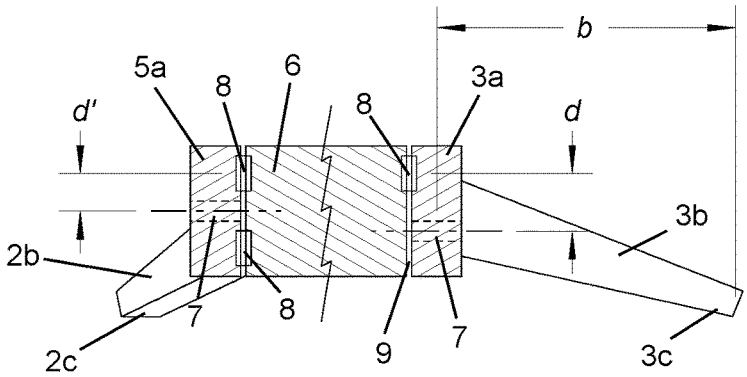
FIG. 2 is a side view through a section of the interconnection means and lever parts showing two sliding interfaces of the stabilizing arrangement.

FIG. 2 shows a side view section through the stabilizing arrangement, with two alternate layouts of pivot pin or bolt 7 and bearing 8. The left hand side of the FIG. 2 shows an arrangement where the pivot pin or bolt 7 is vertically located in the centre of the sliding surfaces of the beam portion 5*a* and the hub or base portion 6. To provide a repeatable and/or desired coefficient of friction between the two sliding surfaces one or more pieces of material of bearing 8 (such as a bearing material like PTFE) can optionally be bonded to one of the surfaces, or inserted into recesses provided in the sliding surfaces. Alternatively the surface finish and materials of the hub and leg can be chosen to provide the desired coefficient of friction. Also moving the bolt downwards in the sliding surfaces increases the surface area of the sliding surfaces which is above the pivot. In operation, when the vertical reaction force of the leg with the ground inputs a moment on the leg, that moment is reacted at least in part by an increase in load between the sliding surfaces above the pivot and by an increase in tension in the bolt 7. If a bearing material is used between the sliding surfaces, then the contact point between the sliding surfaces where the frictional force is primarily (or effectively) generated is at a distance d' above the pivot axis through the bolt 7. If this distance is increased, then the moment about the pivot axis generated by the friction force acting at the contact point in increased, thereby increasing the damping of the mechanism.

The right hand side of FIG. 2 shows a preferred arrangement where the pivot axis through the bolt 7 is lowered below the vertical centre of the sliding surfaces 9. This increases the distance d between the pivot axis through the bolt 7 and the contact point (for example at the bearing 8 if provided) between the sliding surfaces where the frictional force is primarily generated, increasing the damping effect of the frictional contact between the sliding surfaces and the leg rotates about the pivot axis with operation of the stabilizing arrangement.

Also as can be seen from FIG. 2, increasing the friction loading distance b will increase the moment on the leg 3 which will increase the reaction force at the contact point at bearing 8 between the sliding surfaces 9 which will in turn increase the frictional force at that point and therefore the damping effect on the stabilizing arrangement.

FIGS. 3 to 6 show various views of a possible embodiment of the stabilizing arrangement of the present invention applied to a table in which components similar or equivalent to those in FIGS. 1 and 2 are given like reference numerals. The hub or base portion is hollow having four side walls 6*a*, 6*b*, 6*c* and 6*d* through which the bolts 7 are assembled into blind holes in the beam portions 2*a*, 3*a*, 4*a*, and 5*a* of the legs. The ground engaging point or region on each leg is a respective foot 2*c*, 3*c*, 4*c* or 5*c*.

Figure 3:
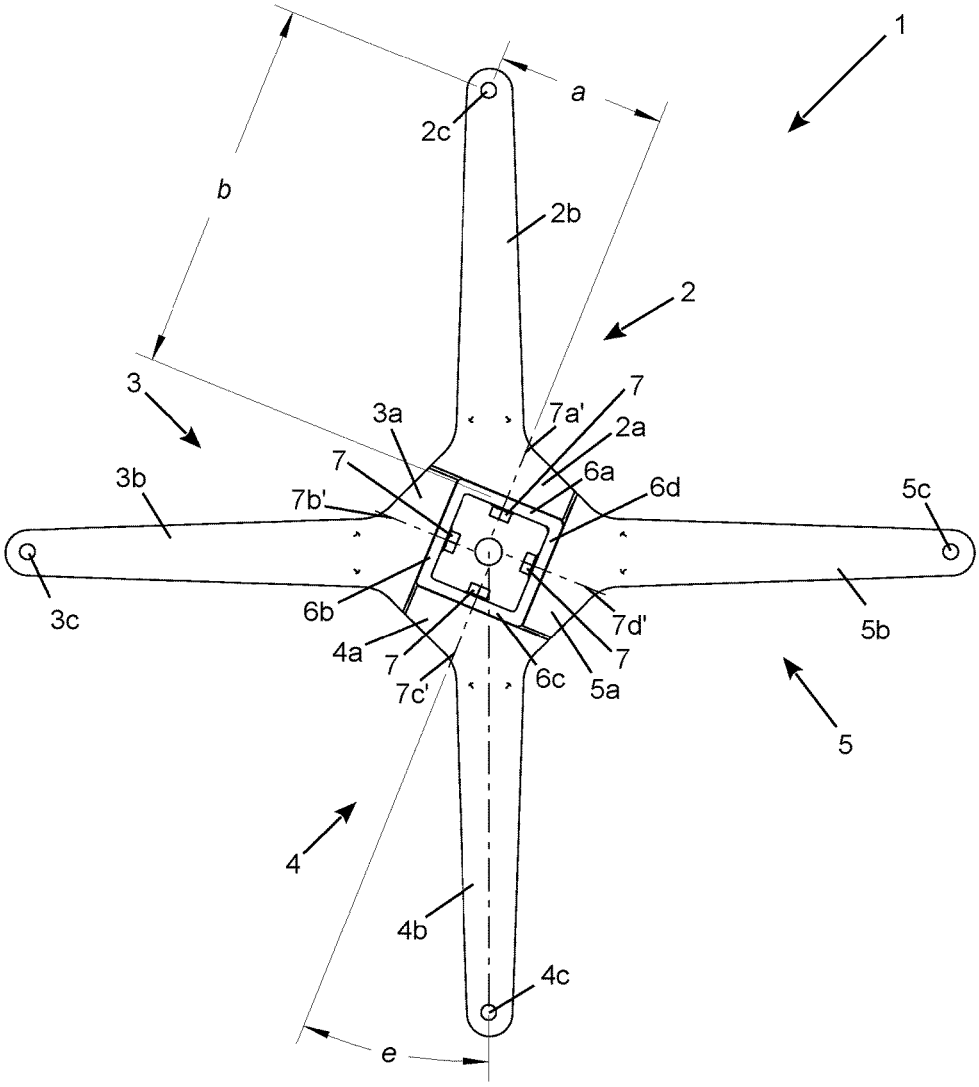
FIG. 3 is a detailed view of the underside of a possible embodiment of a stabilizing arrangement of the present invention.

In FIG. 3 the primary lever-rotating arm a and the friction loading distance b are again indicated. However, the position of each foot can alternatively be defined as falling on a line through the centre of the hub and at an angle e from the pivot axis of the respective lever part. For example foot 4*c* lies on a line through the centre of the hub, that line being at an angle e from the pivot axis 7*c*'. This angle e is less than 45 degrees and greater than zero and is preferably approximately 22.5 degrees although the ideal angle can vary with for example different sizes of stabilizing assembly, frictional properties of the components, pivot tightening or clamping torques, differing applications and objects being supported, and the amount of mechanism damping required.

Figure 4:
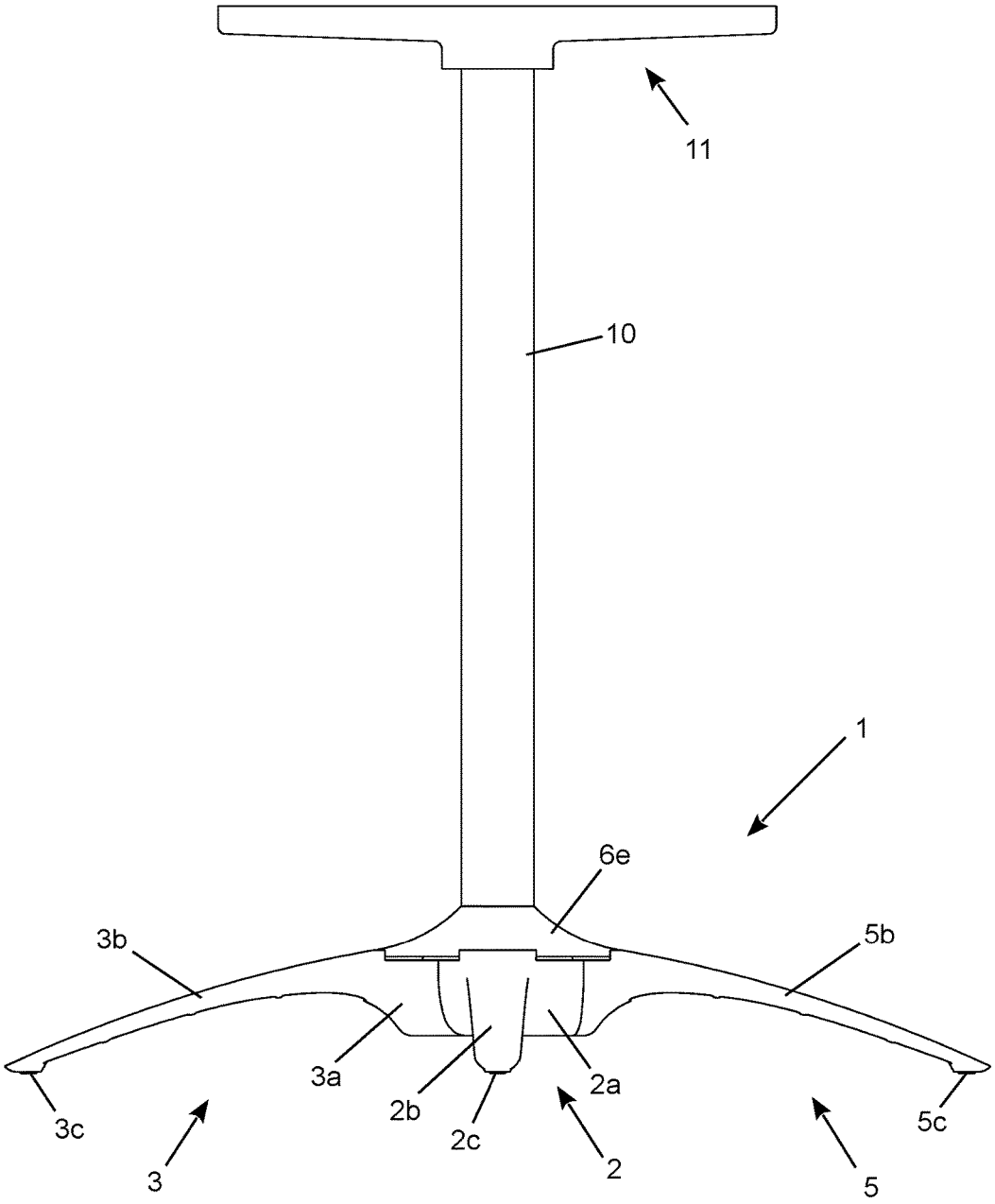
FIG. 4 is a side view of the stabilizing arrangement of FIG. 3
Figure 5:
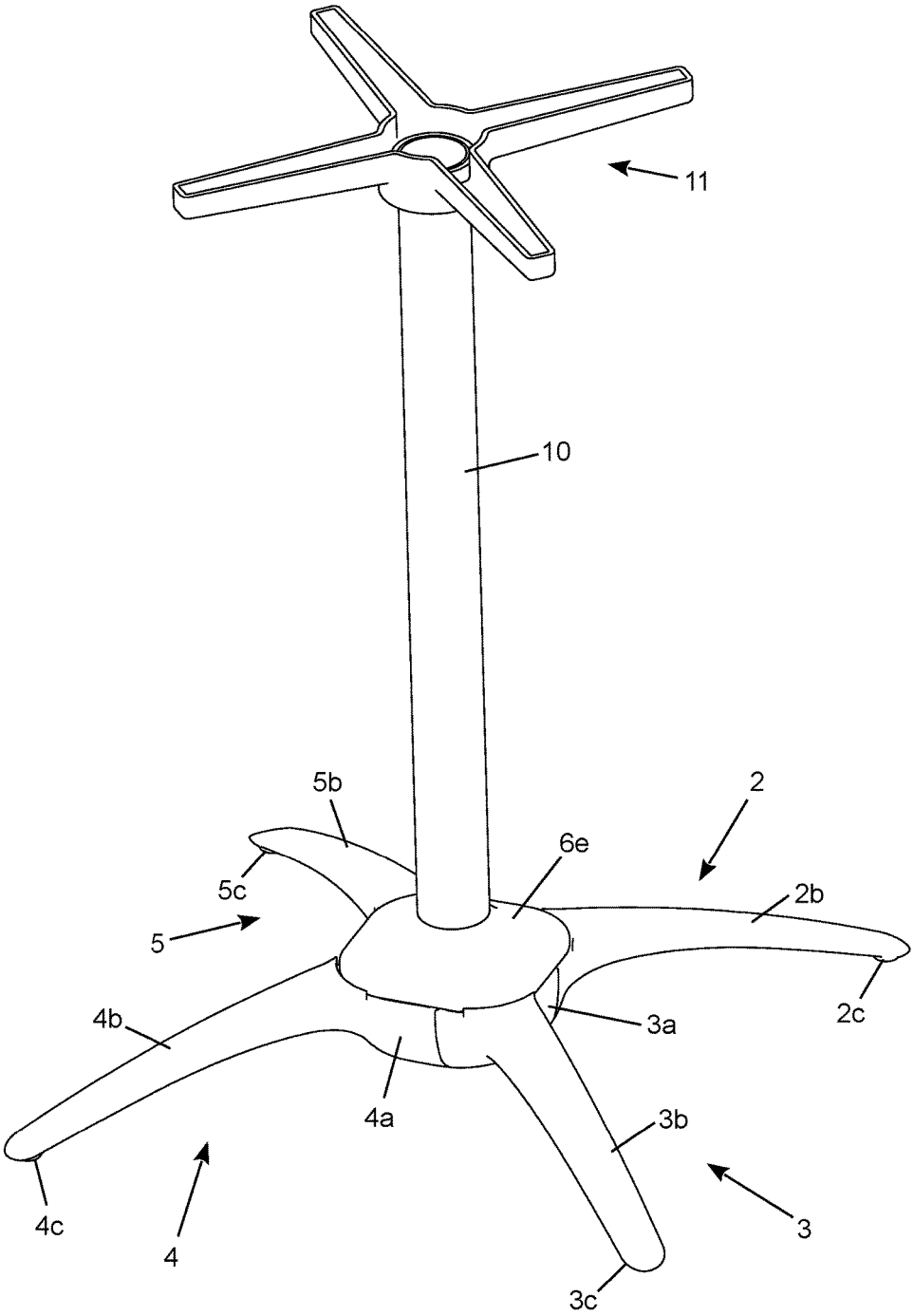
FIG. 5 is a perspective view of the stabilizing arrangement of FIG. 3.

In FIGS. 4 and 5 a stem 10 is shown connected to the base portion 6 and a brace or bracket 11 to which a table top (not shown) can be fitted is connected to the top of the stem.

Figure 6:
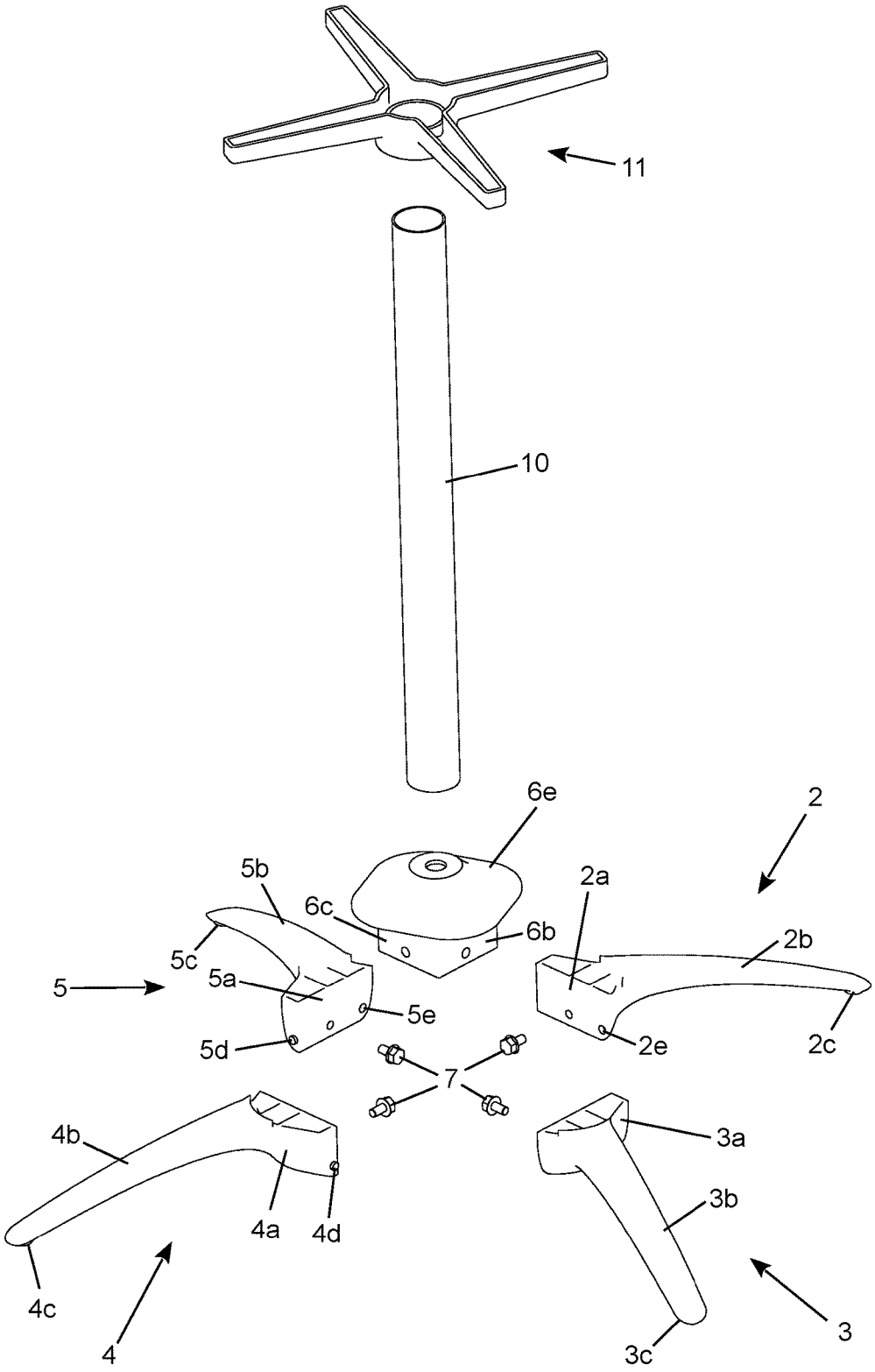
FIG. 6 is an exploded view of the stabilizing arrangement of FIG. 3.

In FIG. 6, the four side walls 6*a*, 6*b*, 6*c*, and 6*d* of the base portion each has an outer sliding surface and the base portion 6 further includes an integrated top cover 6*e* to act as a travel limiting stop.

If a separate bearing is used, such as a sheet of suitable material, the sheet can include a folded edge or tags substantially perpendicular from the sheet of bearing material to engage with purpose provided slots in the side walls of the base portion or lever part, or the folded edges or tags can engage one or more edges of the base portion or lever part to prevent the bearing material working out of the desired position.

The lengths of the four side walls of the base portion in plan view do not need to be the same length or perpendicular to each other. For example the four side walls (and the beam portions of the legs) can be arranged in a rectangular, rhombus or other quadrilateral shape.

Also in FIG. 6 the protrusion 2*d*, 3*d*, 4*d* or 5*d* is shown extending from the end of the beam portion of each respective leg and the engaging region on or in each leg is shown as a receiving hole 2*e*, 3*e*, 4*e* or 5*e* respectively. The positions of the protrusions and receiving holes can be swapped, although this does move the engaging regions (and each instantaneous engaging zone) in the mechanism.

The instantaneous engaging zone is where the lower surface of the protrusion contacts the lower surface of the receiving hole. Ideally, the instantaneous engaging zone is at the same height (or in the same plane) as the pivot axes of the lever parts when all lever parts are in the neutral position (at the centre of their rotation) and all four feet of the mechanism are lying in the same plane (that plane being parallel to the plane through all of the pivot axes). This minimises the change in horizontal displacement of the instantaneous engaging zone (or point) as the lever parts rotate with operation of the mechanism.

Also ideally the receiving holes are laterally elongated to accommodate the change in horizontal displacement of the instantaneous engaging zone as the lever parts rotate with operation of the mechanism while limiting the vertical clearance between the top of the protrusion and the top of the receiving hole. This is illustrated on the lever part 5 in FIG. 7 where the height of the lower surface of the protrusion 5*d*is at the same height (or in the same plane) as the lower surface of the elongated receiving hole 5*e* and the pivot axis 7*d*' of the lever part. The length of the pivot axis 7*d*' has been increased to reach the protrusion and receiving hole to illustrate the alignment.

When lever parts with this geometry are assembled on the base, then when all the feet lie on a common (flat) ground plane, the instantaneous engaging zones and the pivot axes all substantially lie on a plane parallel to the common ground plane.

Figure 7:
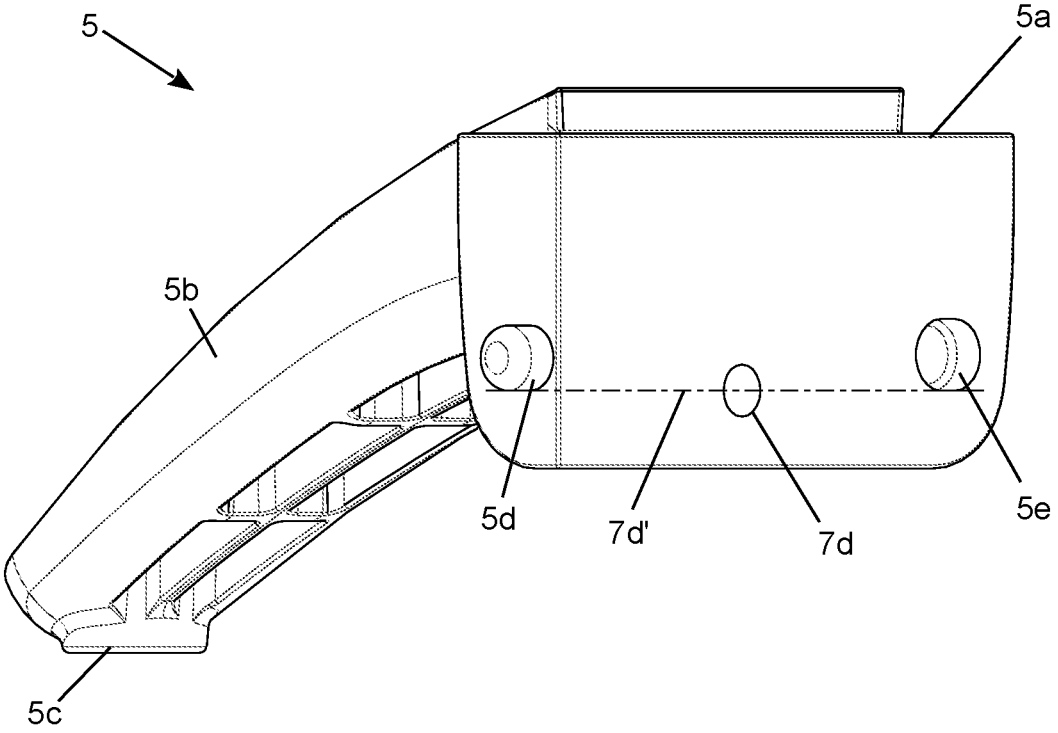
FIG. 7 is a rear view of a lever part of a stabilizing arrangement of the present invention.

The protrusion is ideally not face ended (i.e. not flat ended) at its distal end and can have a ball on the end which contacts the bottom of the receiving hole of an adjacent lever part, or as shown in FIG. 7, can have a cylindrical shape with a radius on the end.

The protrusion of each lever part can be a cylindrical pin having a distal end that is at least partially rounded and the receiving hole of each lever part is an elongate opening having rounded or curved ends (i.e. a curved or rounded ended slot)

Although the above description and the drawings disclose four lever parts (or legs), it is possible to use any even number of legs from four upwards, although the complex warped surface defined by the motion of the six or more ground engaging means may not match the uneven surface with which the stabilizing arrangement is engaged, so not all six ground engaging means may contact the uneven surface.

The invention claimed is:

1. A stabilizing arrangement to support an object above four ground engaging means, the arrangement including:

an interconnection means interconnecting four lever parts including a first lever part, a second lever part, a third lever part and a fourth lever part, each respective lever part connected to the interconnection means by a respective pivot having a respective pivot axis;

each respective lever part including a first and a second engaging region, the first engaging region of each respective lever part being located on an opposite side of the respective pivot axis to the second engaging region of the respective lever part in plan view;

each respective ground engaging means being attached to or integral with a respective lever part, the respective ground engaging means of each lever part being located on an opposite side of the respective pivot axis to the respective first engaging region;

the first engaging region of the first lever part, in use engaged with the second engaging region of the second lever part, the first engaging region of the second lever part, in use engaged with the second engaging region of the third lever part, the first engaging region of the third lever part, in use engaged with the second engaging region of the fourth lever part, the first engaging region of the fourth lever part, in use engaged with the second engaging region of the first lever part such that rotation of the first lever part drives a rotation of the second lever part which drives rotation of the third lever part in a substantially opposite direction to the first lever part and the rotation of the third lever part driving a rotation of the fourth lever part in a substantially opposite direction to the second lever part to permit a warp displacement of the four ground engaging means, the stabilizing arrangement thereby providing support of the object on uneven ground, and for each respective lever part, the distance between the respective ground engaging means and the respective pivot axis is a primary lever-rotating moment arm measured perpendicular to the respective pivot axis, and for each respective lever part, the distance between the respective ground engaging means and a portion of the respective pivot is a friction loading distance measured parallel to the respective pivot axis, and wherein the friction loading distance is greater than or equal to the primary lever-rotating moment arm.

2. The stabilizing arrangement according to in claim 1, wherein the distance of the first or second engaging region of a said lever part from the pivot axis of said lever part is a beam loading distance and the ratio between the primary lever-rotating moment arm and the beam loading distance is between 1.5:1 and 4:1.

3. The stabilizing arrangement according to claim 1, wherein the ground engaging means of a respective lever part is positioned on a respective line through a centre of the interconnection means, an angular separation of the respective line relative to the respective pivot axis for the respective lever part is less than 45 degrees and greater than 0 degrees when viewed in underside plan view of the support arrangement.

4. The stabilizing arrangement according to claim 1, further including a respective sliding interface between each respective lever part and a respective side of the interconnection means.

5. The stabilizing arrangement according to claim 4, wherein the respective pivot is below a centre of the respective sliding interface.

6. The stabilizing arrangement according to claim 4, wherein the first engaging region of each lever part is a protrusion extending parallel to the sliding interface and the second engaging region of each lever part is a receiving hole perpendicular to the sliding interface.

7. The stabilizing arrangement according to claim 4, wherein the first engaging region of each lever part is a protrusion extending perpendicular to the sliding interface and the second engaging region of each lever part is a receiving hole parallel to the sliding interface.

8. The stabilizing arrangement according to claim 1, wherein the first engaging region of each lever part is a protrusion and the second engaging region of each lever part is a receiving hole.

9. The stabilizing arrangement according to claim 8, wherein the protrusion of each lever part is a cylindrical pin having a distal end that is at least partially rounded and the receiving hole of each lever part is an elongate opening having rounded or curved ends.

10. The stabilizing arrangement according to claim 8, wherein the protrusion of each lever part in use contacts the receiving hole of an adjacent lever part at an instantaneous engaging zone, the protrusions and receiving holes being positioned such that when all the ground engaging means lie on a common ground plane, the instantaneous engaging zones and the pivot axes substantially lie on a plane parallel to the common ground plane.

11. The stabilizing arrangement according to claim 1, wherein for each respective lever part, the friction loading distance is greater than the primary lever-rotating moment arm.

12. The stabilizing arrangement according to claim 1, wherein for each respective lever part, the friction loading distance is the distance between the respective ground engaging means and a centre of the pivot.

13. The stabilizing arrangement according to claim 1, wherein for each respective lever part, the primary lever-rotating moment arm and the friction loading distance are measured in a substantially horizontal plane that is parallel to an average ground plane or parallel to a plane through the interconnecting means that is horizontal when the four ground engaging means are in contact with a plane that is horizontal.

14. The stabilizing arrangement according to claim 13, wherein the distance of the first or second engaging region of a said lever part from the pivot axis of said lever part is a beam loading distance and the ratio between the lever-rotating moment arm and the beam loading distance is between 1.5:1 and 4:1.

15. The stabilizing arrangement according to claim 13, wherein an angular separation of the ground engaging means of each of the lever parts relative to the respective pivot axis for the respective lever part is less than 45 degrees and greater than 0 degrees when viewed in underside plan view of the support arrangement.

16. The stabilizing arrangement according to claim 13, wherein for each respective lever part, the friction loading distance is the distance between the respective ground engaging means and a centre of the pivot.

17. The stabilizing arrangement according to claim 16, wherein for each respective lever part, the friction loading distance is greater than the primary lever-rotating moment arm.

* * * * *